United States Patent [19]

Arnold

[11] 4,154,996

[45] May 15, 1979

[54] POSITIVE BREAK SNAP ACTION SWITCH

[75] Inventor: John E. Arnold, Bloomfield Hills, Mich.

[73] Assignee: McGraw-Edison Company, Elgin, Ill.

[21] Appl. No.: 796,449

[22] Filed: May 12, 1977

[51] Int. Cl.[2] ..... H01H 15/18

[52] U.S. Cl. ..... 200/77; 200/153 LB; 200/78; 200/159 R

[58] Field of Search ..... 200/67 AA, 67 PK, 77, 200/76, 78, 159 R, 16, 153 LB

[56] References Cited

U.S. PATENT DOCUMENTS

| | | | |
|---|---|---|---|
| 1,907,688 | 5/1933 | Von Henke | 200/77 |
| 2,195,746 | 4/1940 | Hill | 200/77 |
| 2,347,874 | 5/1944 | Bluemle | 200/68 |
| 2,386,162 | 10/1945 | Hetherlington | 200/77 |
| 2,453,231 | 11/1948 | Kavanagh | 200/68 |
| 2,848,575 | 8/1958 | Hahn, Jr. | 200/77 |
| 3,060,285 | 10/1962 | Steinbruner | 200/16 |
| 3,219,776 | 11/1965 | Yerkovich | 200/68 |
| 3,543,589 | 12/1970 | Loughran, Jr. | 200/153 |
| 3,551,614 | 12/1970 | Babler | 200/68 |
| 3,564,174 | 7/1971 | Clarke | 200/77 |
| 3,718,793 | 2/1973 | Obszarny | 200/77 |
| 3,764,762 | 10/1973 | Roeser | 200/68 |

*Primary Examiner*—William Price
*Assistant Examiner*—Joseph M. Moy
*Attorney, Agent, or Firm*—Jon Carl Gealow; Thomas E. McDonald; Ronald J. LaPorte

[57] ABSTRACT

A switch of the type utilized for machine tool controls and actuated by a roller passing over a cam track has two members mounted for independent reciprocation along a plunger actuated from the cam track. One of the members carries a movable contact or contacts, while the second member is utilized to trigger the first member. Each of the members is independently activated by an associated overcenter arrangement for snap action. A compression spring is utilized to return drive the plunger from the position to which it is moved by the action of the roller on the cam track. Movement of the plunger under the driving force of either the roller and cam track or the compression spring provides for a snap action of both members in the appropriate direction upon activation by their respective overcenter arrangement. The plunger is driven by the cam track to provide a positive contact break, while the compression spring provides an additional opening force in the other direction, if the overcenter arrangements for the two members do not succeed in effecting the desired contact opening.

14 Claims, 15 Drawing Figures

POSITIVE BREAK SNAP ACTION SWITCH

BACKGROUND OF THE INVENTION

1. Field of the Invention

This invention relates generally to an electrical switch, and more specifically, this invention relates to an electrical switch in which snap action of movable contacts is achieved in conjunction with a positive override to insure contact breaking in one direction of actuation and a supplemental force to assist in contact breaking in the other direction.

2. Description of the Prior Art

In cam actuated switches, such as those utilized in connection with machine tool controls, it is desirable to cause very rapid opening of the switch contacts, such as by utilization of an overcenter arrangement to achieve snap action. In addition, it is desirable to insure that contact opening will occur even if the overcenter arrangement does not succeed in producing the snap action of the switch contact (e.g., contact welding may occur that the overcenter arrangement is not sufficiently strong to break). This override or assured contact breaking is frequently referred to as a positive break action. Further, it is desirable to assist the return action of the contacts in the event that the overcenter arrangement is not sufficiently strong to produce contact breaking in the direction of actuation.

In addition to providing the positive break snap action in one direction of switch actuation and the supplemental breaking force in the other direction, it is necessary to take into account the fact that in many environments, such as machine tool controls, there are considerable vibrations and other undesired forces acting upon the switch actuating plunger. Accordingly, it is necessary that the switch have a certain amount of free play to prevent undesired switch actuations. At the same time, however, it is necessary that when switch actuation is called for it be done with a snap action to preclude "teasing" or partial openings and closings of the switch contacts. Such teasing or partial makes and breaks of the contacts can result in deleterious arcing producing pitting and other undesired effects of wear of the contacts.

Various types of snap switches have been utilized in the prior art to achieve the desired switch operation. However, none of the prior art switches have been able to successfully combine the features referred to above. Further, many of these prior art approaches have involved relatively expensive switch components and have lacked the desired strength and durability for the type of environment in which such a switch is utilized.

SUMMARY OF THE INVENTION

The present invention obviates many of the difficulties of prior art switching devices and provides a switch that operates in a non-teasing or snap-action fashion and includes provision for positive break of the contacts in one direction of actuation and a supplemental breaking force in the other or return direction of actuation. Of course, while the preferred embodiment disclosed herein is directed toward a bridging contact member for two sets of contacts, the principles disclosed may also have applicability to a single set of contacts or any other appropriate contact arrangement. In addition to providing the desirable features mentioned, the switch of this invention is relatively inexpensive to manufacture, is easily assembled and exhibits strength and durability.

A longitudinally reciprocating actuating plunger is actuated by a cam track through a roller mounted on one end of the plunger. A compression spring bears against the other end of the plunger to provide a return force after displacement of the plunger by the cam track. A contact carrying member and a trigger member are mounted for independent reciprocable motion along the plunger, the triggering member being confined to a limited extent of travel along the plunger adjacent the roller bearing end. The roller is appropriately mounted on the end of the plunger, such as by a yoke supporting an axle for the plunger.

The contact carrying member supports an appropriate movable contact, such as a metal contact bridge, at an end opposite the triggering member. Longitudinally extending slots are formed in the contact carrying member to provide a certain degree of flexibility of the sides of the contact carrying member when not mounted on the plunger. Further, sloping cam surfaces are formed on the end of the contact carrying member so that the contact bridge can be forced over the end of the contact carrying member, when the contact carrying member is not located on the plunger, to be seated in an appropriate mounting groove. The bottom portion of the contact carrying member is a cam element on which are formed V-shaped cam surfaces diametrically opposite from one another. The V-shaped cam surfaces interact with spring-biased spherical balls to provide an overcenter arrangement. A passageway having a rectangular cross section permits sliding motion of the contact carrying member along a rectangular cross-sectional portion of the plunger.

Between the rectangular cross-sectional portion of the plunger and the roller supporting yoke, there is located a circular cross-sectional portion along which the trigger member reciprocates. The trigger member has a passageway therethrough with a rectangular cross section so that it can be passed over the rectangular cross-sectional portion of the plunger. When located on the circular cross-sectional portion of the plunger, the trigger member is positioned such that the rectangular cross section of the passageway therethrough is skewed with respect to the rectangular cross-sectional portion of the plunger, in order to restrict the trigger member to the circular cross-sectional portion. Skewing of the trigger member passageway with respect to the rectangular cross-sectional portion of the plunger is achieved by an appropriate interconnection between the trigger member and the contact carrying member, such as a pair of arms with enlarged head portions extending from the trigger member. Cooperating flanges on the contact carrying member have a central opening through which the arms may pass, but which will not permit passage of the enlarged head portions. Mating sloping cam surfaces are formed on the flanges and the enlarged head portions, so that, in view of the existence of some flexibility in the extending arms, the enlarged head portion may be forced over the flanges after the trigger member has been located on the circular cross-sectional portion of the plunger. Diametrically opposing V-shaped cam surfaces are also formed on the triggering member, to thus form another overcenter arrangement in connection with a second pair of spring-biased spherical balls.

The switch components are located in a casing having two identical opposing sections, so that only one casing component is required. Stationary contact posts, carrying the stationary contacts engaged by the bridging member, are also identical, so that even for four stationary contacts only one form of contact post is required. With the structure described, the components may be easily assembled and inserted into the two casing halves, which may then be joined by any appropriate fastening means, such as bolts.

With this arrangement, a sufficient inclination of the cam track will force the triggering member to an overcenter position, from whence its associated overcenter arrangement will activate the triggering member to move with a snap action to strike the contact carrying member. As the springs of the overcenter arrangement for the triggering member are stronger than those for the overcenter arrangement of the contact carrying member, the contact carrying member will also be moved to an overcenter position, from whence its associated overcenter arrangement will activate it to transfer the movable contact or contacts with a snap action. After the roller passes over the raised portion on the cam track, the compression spring will force the plunger back the other direction and the rectangular cross-sectional portion of the plunger will move the triggering member to an overcenter position. Upon activation of the triggering member it will pull the contact carrying member to an overcenter position through the arms extending from the triggering member and engaging the flanges on the contact carrying member. This will result in the movable contact or contacts being transferred with a snap action in the opposite direction. If the overcenter arrangements do not result in a transfer of the movable contact or contacts, the cam track will cause the triggering member to forcibly move the contact carrying member to achieve a positive break of the contacts, and the compression spring will provide a supplemental breaking force in the return direction.

Accordingly, a switch has been provided which will yield positive break snap action of the switch contacts in one direction of throw and a supplemental breaking force while at the same time providing a structure that is easily manufactured and assembled at a relatively low cost. In addition, the switch is strong and durable and well adapated for use in the demanding environments to which it will be exposed.

These and other objects, advantages and features of this invention will hereinafter appear, and for purposes of illustration, but not of limitation, an exemplary embodiment of the present invention is shown in the appended drawing.

DETAILED DESCRIPTION OF THE PREFERRED EMBODIMENT

Figure 1:
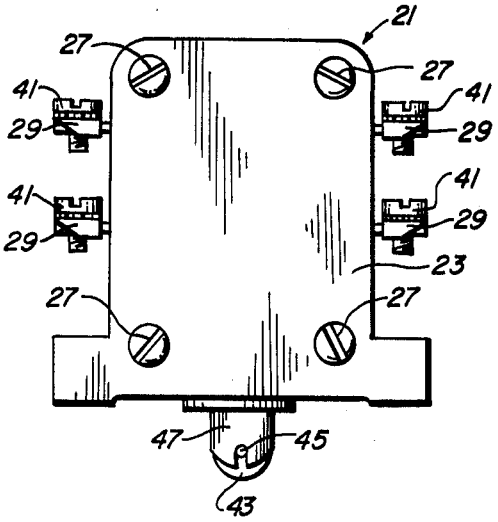
FIG. 1 is a front elevational view of a switch constructed in accordance with the present invention.
Figure 2:
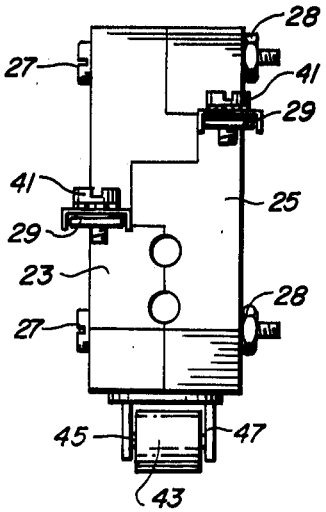
FIG. 2 is a right side elevational view of the switch of FIG. 1.
Figure 3:
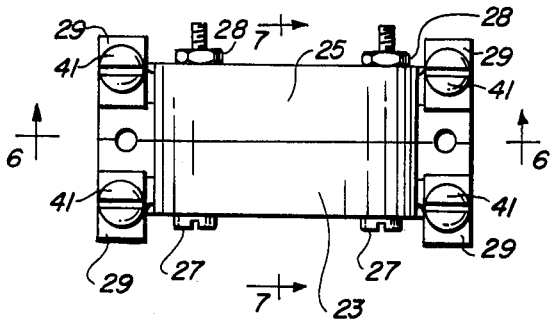
FIG. 3 is a top plan view of the switch of FIG. 1.

With reference to FIGS. 1–3, a switch 21 constructed in accordance with the present invention is shown assembled in a casing having casing sections 23 and 25. Casing sections 23 and 25 may be connected together in any appropriate fashion, such as by threaded bolts 27 having appropriate nuts 28.

Extending from the switch casing are the external connection portions of a number of terminals 29. In this particular case, four such terminals 29 are employed, as one set of contacts is closed and another set opened by actuation in each direction of operation. Of course, only two such stationary terminals 29 would be utilized if a single switch breaking and making action were required. Also, of course, any other appropriate type of contact arrangement could be utilized. All of the terminals 29 are formed identically, so that only one style of terminal needs to be manufactured. Each of the terminals 29 has a portion 31 on which a stationary contact 33 is secured. A portion 35 of each terminal 29 extends through the switch casing on a connecting leg 37 and contains a threaded opening 39 to receive an external connecting bolt or screw 41.

Figure 11:
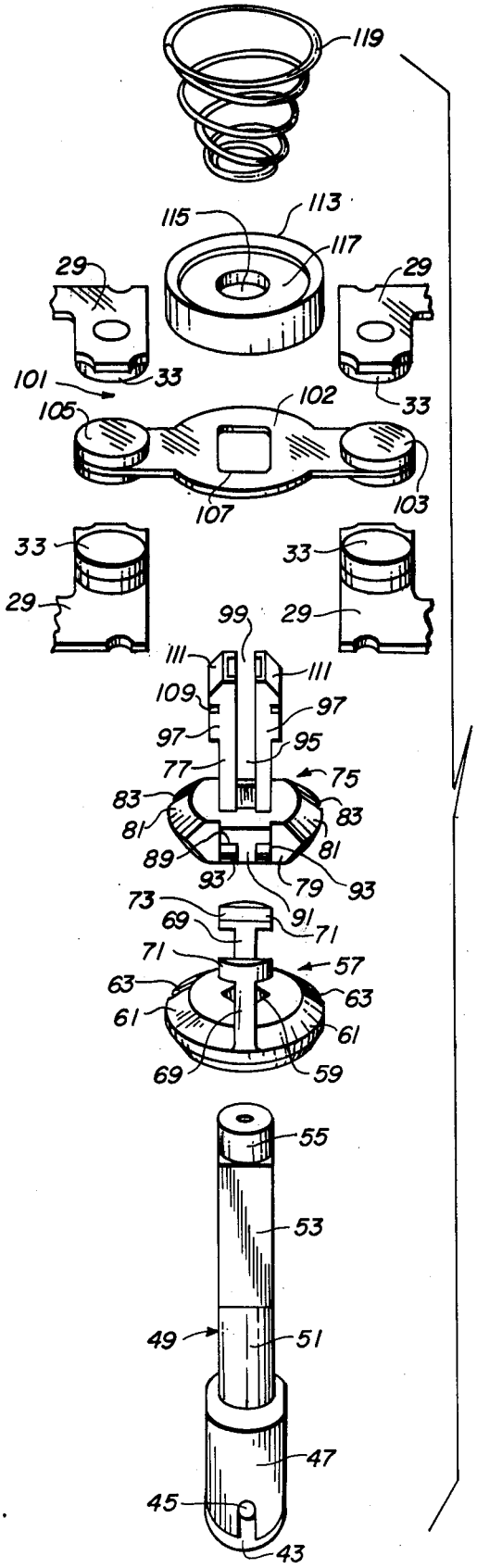
FIG. 11 is an exploded view illustrating the switch components within the casing of the switch of FIG. 1.

An actuating roller 43 has a supporting axle 45, which may be mounted, such as by a press fit, in a yoke 47. Yoke 47 is attached to, or integrally formed with, a switch actuating plunger 49 (FIG. 11).

To more clearly envision the switch components, reference may be made to FIGS. 6–11. From these FIGURES, it may be seen that actuating plunger 49 has a first circular cross-sectional portion 51, a rectangular (square in this case) cross-sectional portion 53 and a second circular cross-sectional portion 55. The diameters of portions 51 and 55 are no greater than the shortest side of portion 53 (in this particular preferred embodiment the diameter portions 51 and 55 are equal to the sides of the square portion 53).

A trigger member 57 has a passageway 59 with a rectangular (square) cross section extending therethrough. Passageway 59 has a cross-sectional area sufficient to permit it to slide easily over the rectangular cross-sectional portion 53 of plunger 49. As may best be seen from a comparison of FIGS. 9 and 10, the rectangular cross section 59 of triggering member 57 is skewed with respect to the rectangular cross-sectional portion 53 of plunger 49. Accordingly, longitudinal reciprocation of triggering member 57 is limited to the circular cross-sectional portion 51, extending from the top of yoke 47 to the bottom of the rectangular cross-sectional portion 53.

Diametrically opposing sides of triggering member 57 are provided with V-shaped cam surfaces 61. Actually, in this preferred embodiment, the V-shaped cam surface extends completely about triggering member 57, but all that is required is for the V-shaped cam surface to exist for a sufficient distance to contain races 63, in which spherical balls 65 may move. Spherical balls 65 are biased toward triggering member 57 by bias springs 67. V-shaped cam surfaces 61, balls 65 and bias springs 67 form an overcenter arrangement for the triggering member 57.

Arms 69 are located on triggering member 57 and extend therefrom. These arms 69 may be firmly attached to the triggering member 57, or formed integrally therewith. Each of the arms 69 has an enlarged head portion 71. The top portion of each of the enlarged heads 71 has a sloping cam surface 73 formed thereon.

A contact carrying member 75 has an extended contact supporting portion 77 and a cam portion 79. V-shaped cam surfaces 81 are formed on diametrically opposite sides of cam portion 79. A race 83 is formed in each of the cam surfaces 81 to receive a spherical ball 85, balls 85 being biased toward contact carrying member 75 by springs 87. V-shaped cam surfaces 81, balls 85 and bias springs 87 form an overcenter arrangement for the contact carrying member 75.

A pair of flanges 89 are formed on contact carrying member 75, each of the flanges 89 being adapted to engage an arm 69 to interconnect triggering member 57 and contact carrying member 75. Each of the flanges 89 has a central opening 91 through which an arm 69 may easily pass. However, openings 91 prevent passage of enlarged head portions 71. Each of the flanges 89 has a pair of sloping cam surfaces 93 to mate with the sloping cam surfaces 73 on enlarged head portions 71. Due to a certain amount of flexibility in the extending arms 69, forcing contact carrying member 75 toward triggering member 57 to engage the mating sloping cam surfaces 73 and 93 will permit the enlarged head portions 73 to pass over flanges 89 and snap into the interlocking position with arms 69 in central openings 91.

Extending contact supporting portion 77 of contact carrying member 75 has a pair of slots 95 formed to extend along the length of this portion, so that portion 77 is divided into two parts 97. As a result of the slots 95, the parts 97 have a certain degree of flexibility, when the contact carrying member is not located on portion 53 of the plunger. A passageway 99 having a rectangular cross-sectional area extends through both portions 77 and 79 of contact carrying member 75. This passageway 99 has a cross-sectional area such that it can move freely on the rectangular cross-sectional portion 53 of plunger 49.

A movable contact member 101 is, in this preferred embodiment, a metallic bridging member 102 carrying a pair of movable contacts 103 and 105. Movable contacts 103 and 105 may be formed as integral units or, as shown in this preferred embodiment, two separate wafers sandwiching the bridging member 102 therebetween. Bridging member 102 has a rectangular central aperture 107 adapted to be located in a mounting groove 109 on contact carrying member 75. Sloping cam surfaces 111 are formed on the ends of parts 97 of the contact carrying member 75, so that when contact carrying member is not located on plunger 49, aperture 107 of bridging member 102 may be forced along the surfaces 111 to pinch parts 97 together and permit bridging member 102 to move to the mounting groove 109. Bridging member 102 will be secured in the mounting groove 109 by the resilient action of parts 97, as well as the supporting effect of rectangular cross-sectional portion 53 when contact carrying member 75 is located on plunger 49.

A spring seat or retaining member 113 has a circular central aperture 115 adapted to fit over circular cross-sectional portion 55 of plunger 49. Portion 55 extends upward beyond the top surface 117 of retaining member 113, to form a centering post for a compression spring 119. Compression spring 119 serves to provide a return force after plunger 49 has been actuated upwardly by an appropriate actuating force, such as a cam track.

Figure 4:
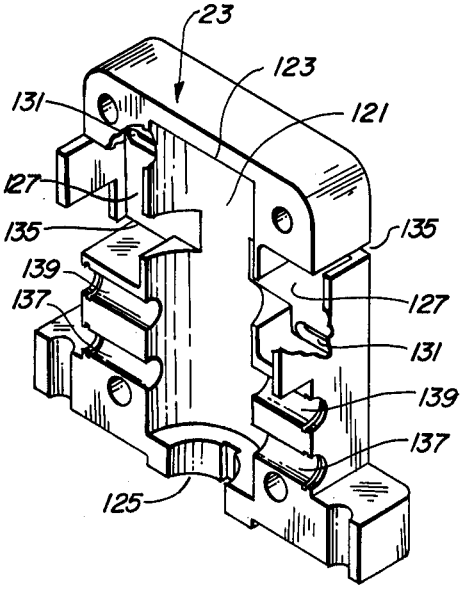
FIG. 4 is a perspective view of a casing section of the switch of FIG. 1.
Figure 5:
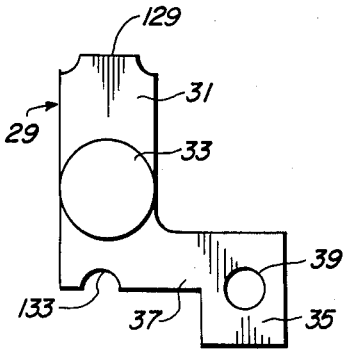
FIG. 5 is a plan view of a contact block utilized in the switch of FIG. 1.
Figure 7:
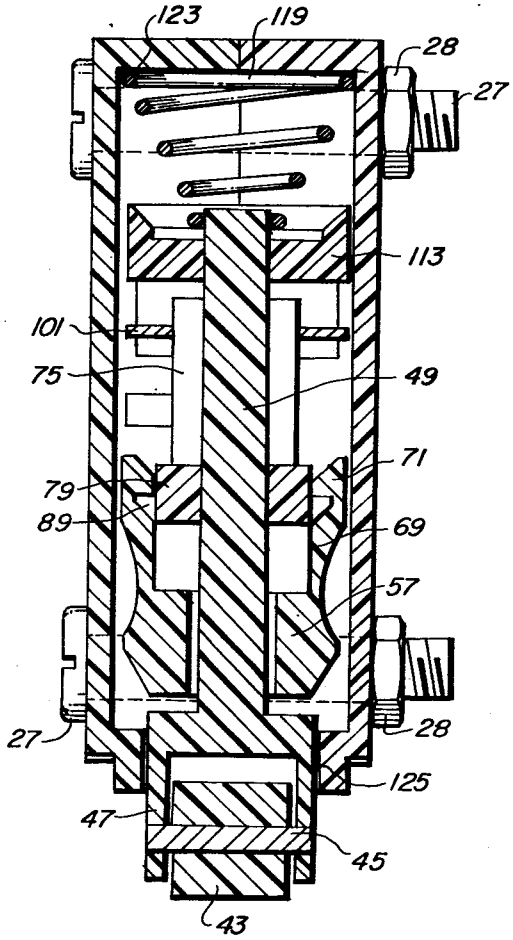
FIG. 7 is a cross-sectional view taken along line 7—7 of FIG. 3.
Figure 6:
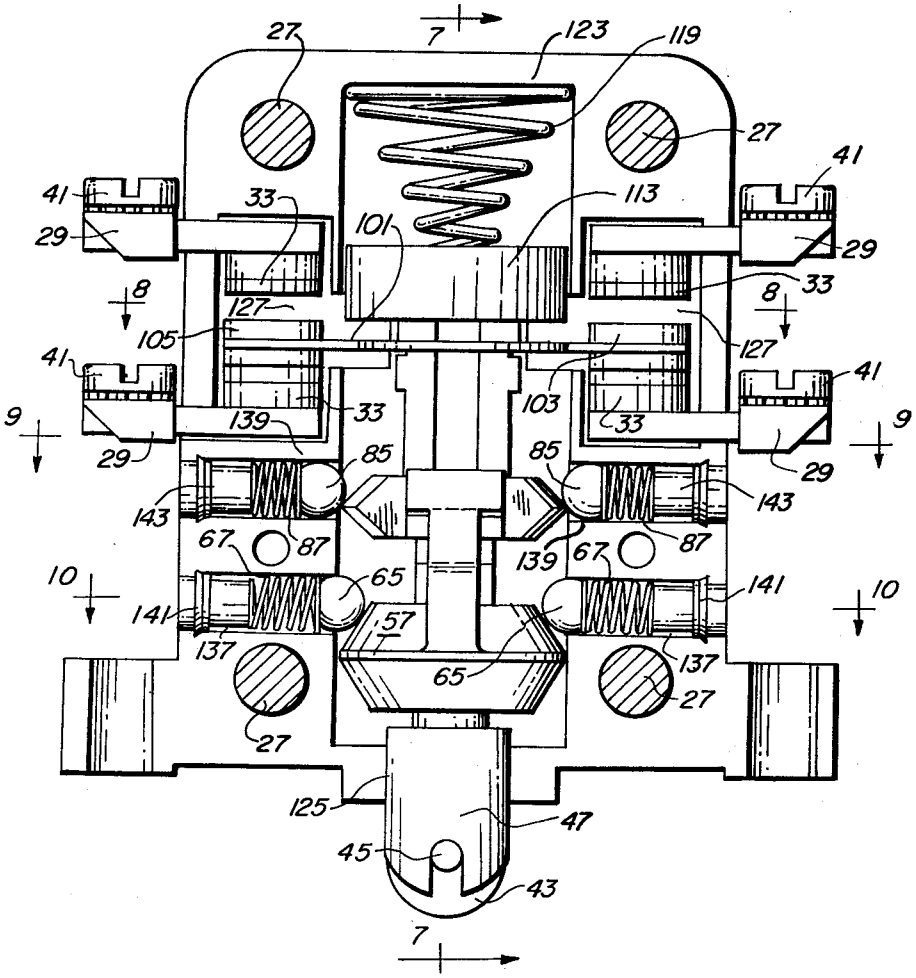
FIG. 6 is a cross-sectional view taken along line 6—6 of FIG. 3.
Figure 8:
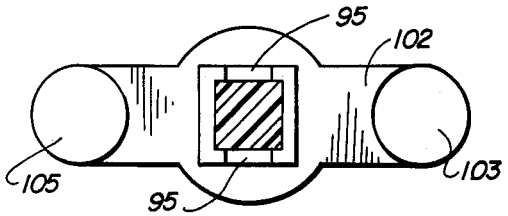
FIG. 8 is a partial cross-sectional view taken along line 8—8 of FIG. 6.
Figure 9:
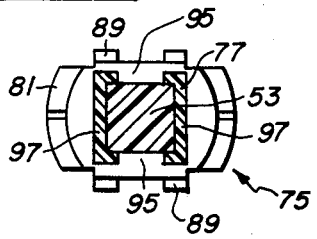
FIG. 9 is a partial cross-sectional view taken along line 9—9 of FIG. 6.
Figure 10:
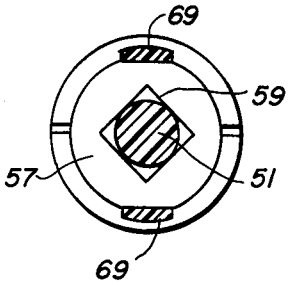
FIG. 10 is a partial cross-sectional view taken along line 10—10 of FIG. 6.

With reference now particularly to FIGS. 4, 6 and 7, the location of the elements in the casing may be seen. In FIG. 4, the internal portion of casing 23 is illustrated, although it would be exactly the same for casing section 25. A central cavity 121 contains the plunger 49, triggering member 57, contact carrying member 75, bridging contact member 101, retaining member 113 and spring 119. Compression spring 119 has the end opposite retaining member 113 positioned against the top surface 123 of cavity 121. Yoke 47 passes through an opening 125 at the bottom of cavity 121. Chambers 127 contain the portions 31 of terminals 29. Ends 129 of portions 31 fit into appropriate openings 131 in chambers 127. Similarly, shoulders 133 of portions 31 fit into appropriate openings 135 in the chambers 127. In this fashion, the identical terminals 29 may be utilized for all the stationary contacts and yet provide the staggered external connection arrangement shown in FIGS. 1–3. Arcuate slots 137 provide an enclosure for balls 65 and springs 67, which are held in place by appropriate stops or plugs 141. Similarly, arcuate grooves or slots 139 contain the spherical balls 85 and their associated springs 87, which are held in position by appropriate plugs or stops 143.

Any suitable material may be utilized for the casing sections 23 and 25, but in this preferred embodiment a lubricant impregnated plastic that has self extinguishing characteristics in the presence of combustion is desired. Similarly, the plunger 49 and associated triggering member 57, contact carrying member 75 and retaining member 113 may be of any suitable material, although in this preferred embodiment, a teflon impregnated melamine that exhibits self extinguishing characteristics in the presence of combustion is utilized. For the contacts, in this preferred embodiment, silver cadmium oxide ($AgCdO_2$) is preferred, although any suitable contact material may be employed. Terminals 29 are any suitable heavy gauge conductive metal, while bridging member 102 is a somewhat lighter metal, also exhibiting conductive characteristics. Compression spring 119 is illustrated as a spirally wound frusto-conical compression spring that exhibits sufficient force in the position shown in FIGS. 6 and 7 to give the desired contact force, as well as being able to return plunger 49, after having been compressed as a result of roller 43 passing over a raised portion in an associated cam track. Of course, spring 119 may be any suitable compression spring, and, for example, a straight or helical spring may be preferable to the frusto-conical form.

Assembly of the switch components in casing sections 23 and 25 may be easily effected. First of all, contact bridge 102 is forced over the cam surfaces 111 to be mounted in the groove 109, while contact carrying member 75 has not yet been placed on plunger 49. Then, triggering member 57 is passed over the rectangular cross-sectional portion 53 until it is positioned on the circular cross-sectional portion 51. Contact carrying member 75 is then placed over the rectangular cross-sectional portion 53. Triggering member 57 is then rotated until arms 69 are aligned with central openings 91 in flanges 89, and enlarged head portions 71 are then forced over flanges 89, which interconnects triggering member 57 and contact carrying member 75 with passage 59 of triggering member 57 skewed with respect to the rectangular cross-sectional portion 53 of plunger 49. Retaining member 113 is then located on circular cross-sectional portion 55, and the plunger 49 and switch components are ready to be located in cavity 121 in casing sections 23 and 25 with compression spring 119. Terminals 29, can then be properly positioned in the casing sections, and the casing sections 23 and 25 are pancaked together and fastened in an appropriate fashion, such as by bolts 27 and nuts 28, or any other type of appropriate fasteners, such as rivet-type eyelets. Balls 65 and 85 and springs 67 and 87 are then inserted into slots 137 and 139, respectively, and held in position by stops or plugs 141 and 143, respectively.

With reference now to FIGS. 6, 7 and 12–15, the sequence of events in connection with the operation of switch 21 may be followed. In FIGS. 6 and 7, the at-rest position of the switch is illustrated. In this position, the force of spring 119 exerted against retaining member 113 forces plunger 49 downward, so that the movable contacts 103 and 105 are in engagement with the lower stationary contacts 33, as shown in FIGS. 6 and 7. Contact carrying member 75 is urged downward by the balls 85 and associated bias springs 87, while triggering member 57 is also urged downwardly by balls 65 and the associated springs 67. The downward extent of travel by the triggering member 57 is limited, however, by the engagement of the movable contacts 103 and 105 with the stationary contacts 33 to restrict the downward motion of contact carrying member 75, and hence the extent of travel of the triggering member 57, as a result of the interconnection of members 75 and 57 through arms 69, enlarged heads 71 and flanges 89.

Figure 12:
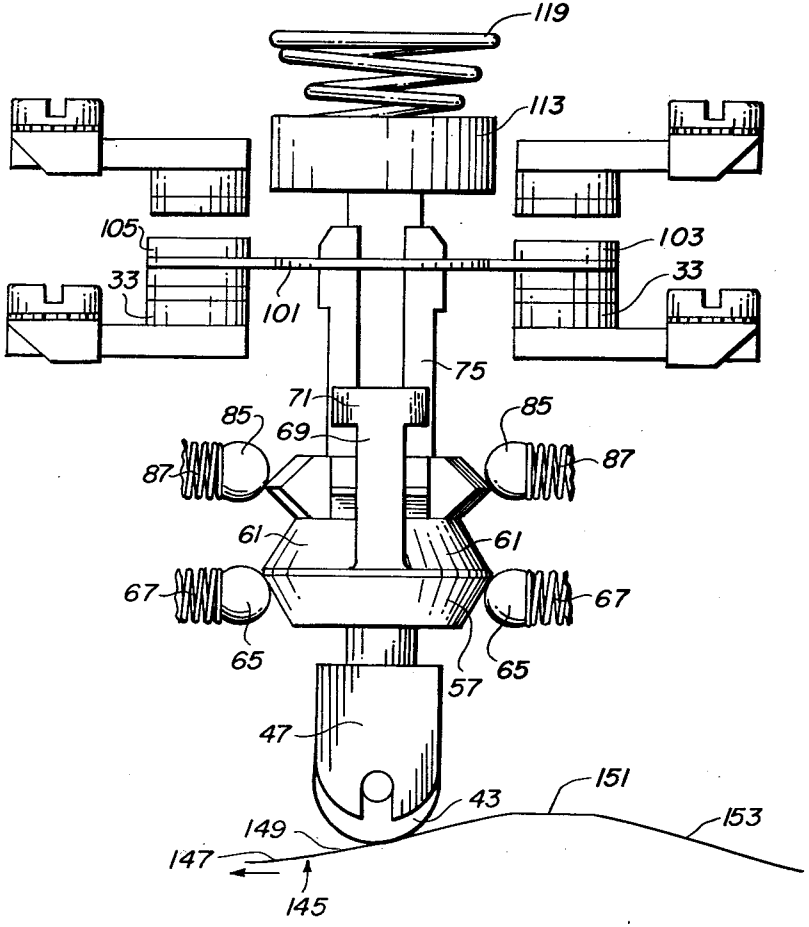
FIG. 12 is a schematic view of the switch components illustrating a first set of operating conditions.

For purposes of reference, a cam track 145 has been schematically illustrated. In this schematic depiction, cam track 145 is shown as a linear track, although it could equally well be, and probably more often would be, a generally circular rotating track. As roller 43 passes along a lower track portion 147, the switch remains in the position shown in FIGS. 6 and 7. When roller 43 starts up an inclined portion 149 of the cam track 145, the top of yoke 47 engages the bottom of triggering member 57 and urges it upward, while also driving actuating plunger 49 upwardly against the force of spring 119. At the point that triggering member 57 has been urged upwardly sufficiently to have the point of the V-shaped surfaces pass the middle of balls 65, balls 65 and their associated springs 67 will force triggering member 57 upwardly to strike contact carrying member 75, as illustrated in FIG. 12. Since the force of the cam track transmitted through roller 43 has driven the plunger 49 upwardly, the triggering member 57 is free to move upwardly under the force of springs 67 and independently of plunger 49.

Figure 13:
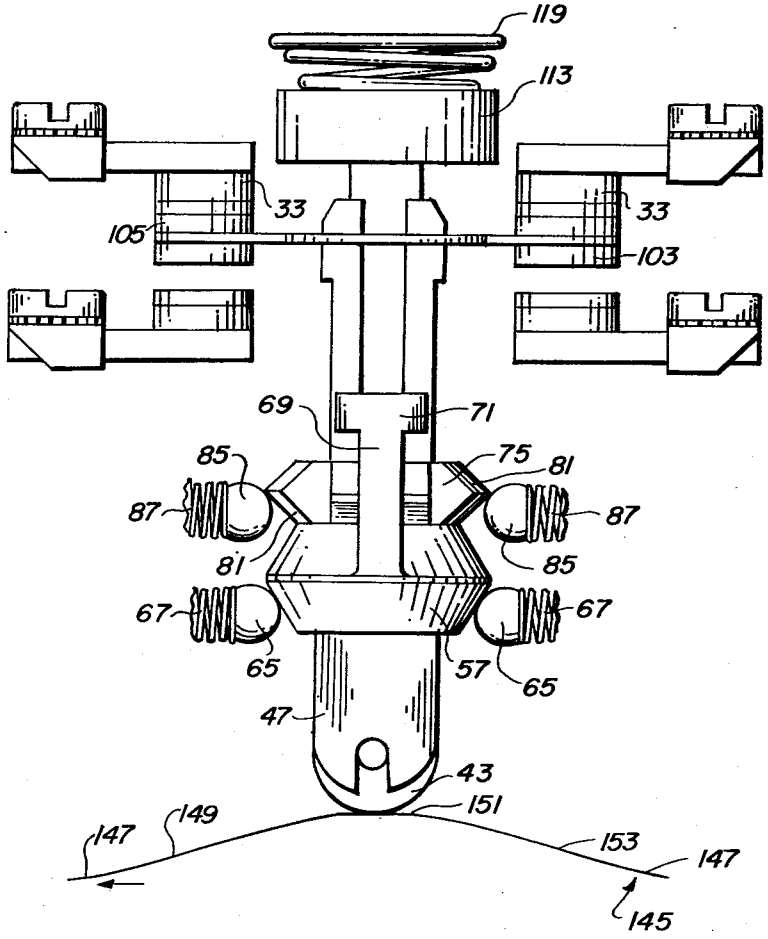
FIG. 13 is a schematic view similar to FIG. 12 illustrating a second set of operating conditions.

Since springs 67 are stronger than springs 87, triggering member 57 forces contact carrying member 75 upwardly until the point of V-shaped surfaces 81 pass the midpoint of balls 85, at which point they are driven upwardly by the force of springs 87. The overcenter action of balls 85 and springs 87 against the V-shaped cam surfaces 81 results in the contact carrying member 75 rapidly conveying movable contacts 103 and 105 from lower stationary contacts 33 to upper stationary contacts 33 with a snap action. As roller 43 continues up slope 149, it moves to a top plateau 151, as illustrated in FIG. 13. Plateau 151 is sufficiently high that if the movable contacts have not left the lower stationary contacts under the force of springs 67 and 87, the cam track acting through roller 43, yoke 47, triggering member 57 and contact carrying member 75 would have forcibly moved the movable contacts 103 and 105 to provide a positive break.

As roller 43 moves down the descending slope or declination 153, spring 119 drives plunger 49 downwardly. This downward motion of plunger 49 forces triggering member 57 downwardly as a result of the skewed relationship between the rectangular cross-sectional portion 53 and the rectangular passageway 59 of triggering member 57. However, contact carrying member 75 is unaffected by this action, and springs 87 maintain contacts 103 and 105 in engagement with upper stationary contacts 33. Finally, the triggering member 57 is urged downwardly so that the point of the V-shaped cam surfaces 61 reach the middle point of balls 65, and springs 67 urge the triggering member 57 downwardly with a snap action. This snap action of triggering member 57 results in the bottom surface of the enlarged heads 71 striking against the top surfaces of flanges 89 on contact carrying member 75. This is the position shown in FIG. 14.

Figure 15:
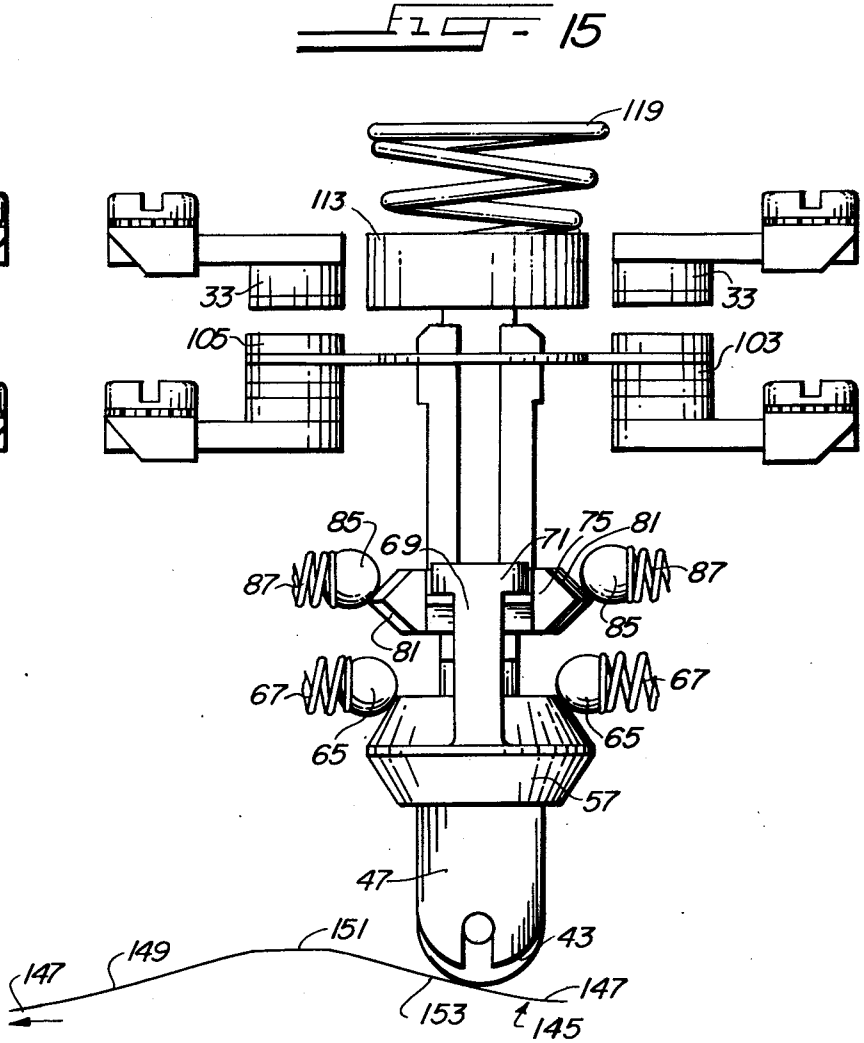
FIG. 15 is a schematic view similar to FIGS. 12–14 illustrating a fourth set of operating conditions.
Figure 14:
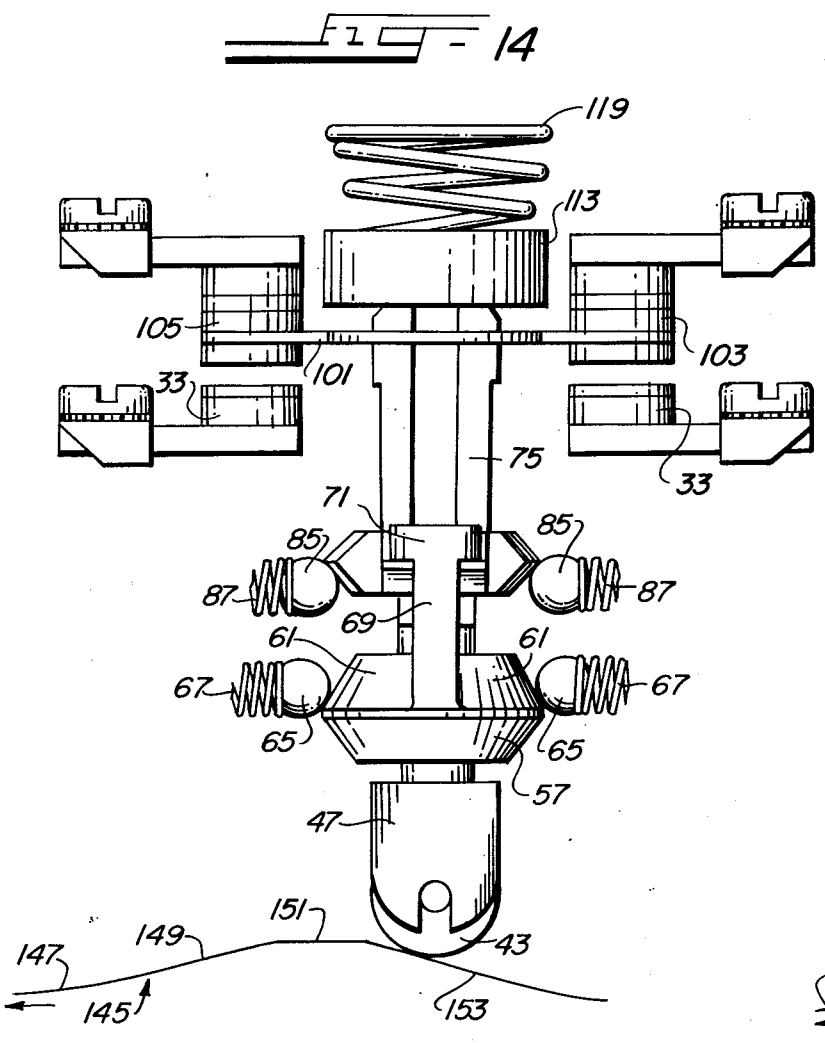
FIG. 14 is a schematic view similar to FIGS. 12 and 13 illustrating a third set of operating conditions.

As before, the greater force of springs 67 causes the contact carrying member 75 to move downwardly until the point of V-shaped surfaces 81 passes the central point of balls 85, at which point movable contacts 103 and 105 are transferred from the upper stationary contacts to the lower stationary contacts 33 with a snap action, as illustrated in FIG. 15. As the roller 43 continues on down slope 153, compression spring 119 continues to urge plunger 49 downwardly, so that if the movable contacts 103 and 105 had not been transferred by the force of springs 67 and 87, spring 119 would have driven the retaining member 113 against the top of contact carrying member 75 to supplement the breaking force and act to forcibly remove the contacts 103 and 105 from the upper stationary contacts 33.

It should be understood that various modifications, changes and variations may be made in the arrangements, operations and details of construction of the elements disclosed herein without departing from the spirit and scope of this invention.

I claim:

1. An electrical switch comprising:

first and second stationary contacts;

a contact carrying member mounted for reciprocable motion;

a first overcenter arrangement to activate said contact carrying member with a snap action in both directions of its reciprocable motion;

a movable contact located on said contact carrying member, said movable contact being conveyed from said first stationary contact to said second stationary contact and from said second stationary contact to said first stationary contact by the reciprocable motion of said contact carrying member;

a triggering member mounted for reciprocable motion;

a second overcenter arrangement to drive said triggering member with a snap action in both directions of its reciprocable motion, each snap action of said triggering member initiating a corresponding snap action of said contact carrying member, whereby said movable contact is conveyed with a snap action to make and break engagement with said first and second stationary contacts;

an actuator mounted for reciprocable motion;

actuating force means to drive said actuator in a first direction to cause said second overcenter arrangement to propel said triggering member with a snap action to thereby initiate snap actuation of said contact carrying member with the resulting snap actuation of said movable contact from said first stationary contact to said second stationary contact, said actuating force means driving said actuator to a position upon said first and second overcenter arrangements failing to convey said movable contact from said first stationary contact, to force said movable contact from said first stationary contact in response to the application of said actuating force means to said actuator; and return force means to drive said actuator in a direction opposite to said first direction to cause said second overcenter arrangement to propel said triggering member with a snap action to thereby initiate snap actuation of said contact carrying member with the resulting snap actuation of said movable contact from said second stationary contact to said first stationary contact, said return force means driving said actuator to a position upon said first and second overcenter arrangements failing to convey said movable contact from said second stationary contact, to convey said movable contact from said second stationary contact in response to the supplementing of the force of said first and second overcenter arrangements by said return force.

2. An electrical switch as claimed in claim 1 wherein said first and second overcenter arrangements comprise:

V-shaped cam surfaces formed on opposing sides of said contact carrying member and said triggering member; and four spring-biased balls, each of said balls engaging a corresponding V-shaped cam surface.

3. An electrical switch as claimed in claim 1 wherein said actuating force means comprises:

a roller mounted on one end of said actuator; and a cam track along which said roller moves.

4. An electrical switch as claimed in claim 1 wherein said return force means comprises a compression spring engaging said actuator.

5. An electrical switch comprising:

a casing;

a stationary contact mounted in said casing;

an actuating plunger mounted for linear reciprocation in said casing and extending outwardly from said casing;

a contact carrying member mounted for linear reciprocation along said plunger;

a first overcenter arrangement to activate said contact carrying member with a snap action in both directions of its reciprocation;

a movable contact mounted on said contact carrying member, said movable contact being conveyed by said contact carrying member to make and break engagement with said stationary contact with a snap action;

a triggering member mounted for linear reciprocation along a limited extent of said plunger, said triggering member being separable from said contact carrying member by a distance limited by two opposed surfaces on said triggering member adapted to engage said contact carrying member with a snap action;

a second overcenter arrangement to activate said triggering member with a snap action in both directions of its reciprocation, each snap action of said triggering member initiating a corresponding snap action of said contact carrying member by pushing said contact carrying member in one direction by a first one of said opposing surfaces and pulling said contact carrying member in the other direction by the other of said opposing surfaces, whereby said movable contact is conveyed with a snap action to make and break engagement with said stationary contact;

actuating force means external to said casing to drive said plunger in a first direction to cause said second overcenter arrangement to propel said triggering member with a snap action to thereby initiate snap actuation of said contact carrying member with the resulting snap actuation of said movable contact to make and break engagement with said stationary contact, said actuating force means driving said plunger to a position upon said first and second overcenter arrangements failing to convey said movable contact to make and break engagement with said stationary contact, to forcibly make and break engagement with said stationary contact in response to the application of said actuating force means to said plunger; and return force means to drive said plunger in the opposite direction to that in which it is driven by said actuating force means to cause said second overcenter arrangement to propel said triggering member with a snap action to thereby initiate snap actuation of said contact carrying member with the resulting snap actuation of said movable contact to make and break engagement with said stationary contact, said return force means driving said plunger to a position upon said first and second overcenter arrangements failing to convey said movable contact to make and break engagement with said stationary contact, to forcibly make and break engagement with said stationary contact in response to the supplementing of the force of said first and second overcenter arrangements by said return force.

6. An electrical switch as claimed in claim 5 wherein:

said limited extent of said plunger has a circular cross-section; and said triggering member has a rectangular cross-sectional passageway therethrough, said rectangular cross-sectional passageway being skewed with respect to a rectangular cross-sectional portion of said plunger to preclude removal of said triggering member.

7. An electrical switch as claimed in claim 5 wherein:

said triggering member includes a pair of arms each having an enlarged head portion, said head portion having a top and a bottom surface; and said two opposed surfaces comprise the top of said triggering member that engages the bottom of said contact carrying member, and further comprise the bottoms of enlarged head portions on a pair of arms extending from said triggering member, said bottoms of said head portions engaging flanges located on said contact carrying member.

8. An electrical switch comprising:

a casing, said casing formed of two mating sections;

four identical terminals, each of said terminals removably engaging both of said sections and each supporting a stationary contact;

fastening means for releasably maintaining said sections in conjunction with one another;

an actuating plunger mounted for linear reciprocation in a central opening formed between said section of said casing;

a roller mounted at one end of said plunger and adapted to engage a cam track to provide an actuating force for said plunger;

a contact carrying member mounted for linear reciprocation along said plunger, said contact carrying member having an elongated body portion with a cam portion at one end thereof and a bridging contact member supporting structure adjacent the other end thereof;

two generally V-shaped cam surfaces formed on diametrically opposite areas of said cam portion of said contact carrying member;

a first pair of generally spherical balls, each of said balls positioned to roll along an associated one of said V-shaped cam surfaces on said contact carrying member;

a first pair of biasing springs located in said casing, each of said biasing springs urging an associated one of said first pair of balls toward its associated V-shaped cam surface so that as said balls pass over the point of the "V" said contact carrying member is activated with a snap action;

a triggering member mounted for linear reciprocation along a limited extent of said plunger;

a pair of arms located on said triggering member and extending toward said contact carrying member, each of said arms having an enlarged head portion formed at the free end thereof;

a pair of flanges formed on said contact carrying member, each of said flanges having a central opening wide enough to permit unencumbered movement of one of said arms therein but preventing passage of said head portion, said contact carrying member thus being separable from said triggering member only to the extent of the length of said arms between said head portions and said triggering member;

two generally V-shaped cam surfaces formed on diametrically opposite areas of said triggering member;

a second pair of generally spherical balls, each of said balls positioned to roll along an associated one of said V-shaped cam surfaces on said triggering member;

a second pair of biasing springs, each of said biasing springs urging an associated one of said second pair of balls toward its associated V-shaped cam surface so that as said balls pass over the point of the "V" said triggering member is activated with a snap action, said triggering member being moved to the overcenter position as a result of said plunger being actuated by said actuating force of said cam track, snap action of said triggering member causing it to strike said contact carrying member to initiate snap action thereof to transfer said bridging contact member from a first pair of said stationary contacts to a second pair, said cam track driving said plunger sufficiently far to forcibly separate said bridging contact member from said first pair of stationary contacts if said first and second pairs of springs and balls do not succeed in doing so;

an enlarged retaining member located at the end of said plunger away from said roller; and a compression spring positioned between said enlarged retaining member and said casing, said spring providing a return force to drive said plunger to move said triggering member to an overcenter position to initiate snap action thereof with the attendant production of a snap action of said contact carrying member as a result of said head portions of said arms striking said flanges, said spring driving said plunger sufficiently far to forcibly separate said bridging contact member from said second pair of stationary contacts if said first and second pairs of springs and balls do not succeed in doing so.

9. An electrical switch as claimed in claim 8 wherein said plunger comprises:

a yoke portion secured at one end thereof to mount said roller;

a circular cross-sectional portion extending from said yoke portion and along which said triggering member reciprocates;

a rectangular cross-sectional portion extending from said circular cross-sectional portion and along which said contact carrying member reciprocates; and a post portion on which said enlarged retaining member is mounted at the end opposite said yoke portion.

10. An electrical switch as claimed in claim 9 wherein:

said triggering member has an internal passageway with a rectangular cross-section to pass over said rectangular cross-sectional portion of said plunger to reach said circular cross-sectional portion;

said contact carrying member has an internal passageway with a rectangular cross-section slightly larger than the area of said cross-sectional portion of said plunger to permit sliding motion therealong;

said arms are located on said triggering member in position such that, when said arms are placed in said central openings of said flanges on said contact carrying member, said triggering member is positioned with the rectangular cross-section of its internal passageway skewed with respect to said rectangular cross-sectional portion of said plunger to prevent said triggering member from passing over said rectangular cross-sectional portion; and said enlarged retaining member is removably mounted on said post portion of said plunger.

11. An electrical switch as claimed in claim 10 wherein:

said bridging contact member supporting structure of said contact carrying member has two sections with sloping cam surfaces at the free ends thereof;

said contact carrying member has slots formed along the sides of said contact carrying member between said supporting structure sections to provide flexibility of the contact carrying member, said bridging contact member being forced over said sloping cam surfaces, when said contact carrying member is not mounted on said plunger, to be stationed in a mounting groove formed in said supporting structure; and mating sloping cam surfaces formed on said head portion of said arms and said flanges on said contact carrying member, said arms being sufficiently flexible to permit said head portions to pass over said flanges when said contact carrying member is forcibly urged toward said triggering member positioned on said circular cross-sectional portion of said plunger.

12. An electrical switch as claimed in claim 11 wherein:

races are formed in said V-shaped cam surfaces of said contact carrying member and said triggering member to position said balls; and said post portion of said plunger extends beyond said enlarged retaining member to form a centering post for said compression spring.

13. An electrical switch comprising:

first and second stationary contacts;

a contact carrying member mouned for reciprocable motion;

a first overcenter arrangement to activate said contact carrying member with a snap action in both directions of its reciprocable motion;

a movable contact located on said contact carrying member, said movable contact being conveyed from said first stationary contact to said second stationary contact and from said second stationary contact to said first stationary contact by the reciprocable motion of said contact carrying member;

a triggering member mounted for reciprocable motion;

a second overcenter arrangement to drive said triggering member with a snap action in both directions of its reciprocable motion, each snap action of said triggering member initiating a corresponding snap action of said contact carrying member;

an actuator mounted for reciprocable motion, said actuator including a longitudinally reciprocable plunger;

said triggering member and said contact carrying member are mounted on said plunger;

said plunger has a circular cross-sectional portion and a rectangular cross-sectional portion;

said contact carrying member and said triggering member have rectangular cross-sectional passageways therethrough to permit passage of said members over said rectangular cross-sectional portion of said plunger, said triggering member being positioned over said circular cross-sectional portion of said plunger and said contact carrying member being positioned over said rectangular cross-sectional portion of said plunger;

interconnecting means to join said contact carrying member and said triggering member in a fixed angular relationship with the rectangular cross-sectional passageway of said triggering member skewed with respect to said rectangular cross-sectional portion of said plunger to prevent said triggering member from leaving said circular cross-sectional portion of said plunger;

actuating force means to drive said actuator in a first direction to cause said second overcenter arrangement to activate said triggering member with the resulting initiation of a snap action of said contact carrying member to convey said movable contact from said first stationary contact to said second stationary contact, said actuator being driven by said actuating force means to a position to positively separate said movable contact from said first stationary contact if said first and second overcenter arrangements do not succeed in doing so; and return force means to drive said actuator in a direction opposite to said first direction to cause said second overcenter arrangement to activate said triggering member with the resulting initiation of a snap action of said contact carrying member to convey said movable contact from said second stationary contact to said first stationary contact, said actuator being driven by said return force means to a position to assist in separating said movable contact from said second stationary contact if said first and second overcenter arrangements do not succeed in doing so.

14. An electrical switch as claimed in claim 13 wherein said interconnecting means comprises:

a pair of arms located on said triggering member, each of said arms having an enlarged head portion; and a pair of flanges located on said contact carrying member, each of said flanges having a central opening to permit longitudinal movement of an associated one of said arms therein while preventing passage of said head portion, thus permitting separation of said contact carrying member and said triggering member only by an amount equal to the length of said arms, said head portions being positionable with respect to said flanges after said members have been placed on said plunger.

* * * * *